US009384656B2

(12) United States Patent
Patterson et al.

(10) Patent No.: US 9,384,656 B2
(45) Date of Patent: Jul. 5, 2016

(54) FALSE ALARM AVOIDANCE IN SECURITY SYSTEMS FILTERING LOW IN NETWORK

(71) Applicants: Hap Patterson, Boca Raton, FL (US); Joseph E. Hauhn, Hillsboro Beach, FL (US); Paul B. Rasband, Lantana, FL (US); Anthony Mucci, Wellington, FL (US); Stewart E. Hall, Wellington, FL (US)

(72) Inventors: Hap Patterson, Boca Raton, FL (US); Joseph E. Hauhn, Hillsboro Beach, FL (US); Paul B. Rasband, Lantana, FL (US); Anthony Mucci, Wellington, FL (US); Stewart E. Hall, Wellington, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 137 days.

(21) Appl. No.: 14/202,026

(22) Filed: Mar. 10, 2014

(65) Prior Publication Data

US 2015/0254972 A1 Sep. 10, 2015

(51) Int. Cl.
*G08B 29/18* (2006.01)

(52) U.S. Cl.
CPC ..... *G08B 29/185* (2013.01)

(58) Field of Classification Search
CPC ..... G08B 29/185; G08B 13/19602–13/19695; H04N 7/18
See application file for complete search history.

(56) References Cited

U.S. PATENT DOCUMENTS

| | | | | |
|---|---|---|---|---|
| 4,857,912 | A * | 8/1989 | Everett, Jr. | G08B 19/00 340/508 |
| 6,353,385 | B1 * | 3/2002 | Molini | G08B 25/00 340/502 |
| 7,313,821 | B1 | 12/2007 | Steiner et al. | |
| 8,786,425 | B1 * | 7/2014 | Hutz | H04M 11/04 340/506 |
| 2003/0062997 | A1 * | 4/2003 | Naidoo | G08B 13/19656 340/531 |
| 2006/0028334 | A1 * | 2/2006 | Adonailo | G08B 13/04 340/522 |
| 2006/0092011 | A1 | 5/2006 | Simon et al. | |
| 2006/0219473 | A1 * | 10/2006 | Boland | G08B 13/1672 181/139 |
| 2007/0230744 | A1 * | 10/2007 | Dronge | G08B 13/194 382/103 |

(Continued)

OTHER PUBLICATIONS

International Search Report and Written Opinion, PCT/US15/19376.

*Primary Examiner* — Hai Phan
*Assistant Examiner* — Orlando Bousono
(74) *Attorney, Agent, or Firm* — Fish & Richardson P.C.

(57) ABSTRACT

Embodiments of intrusion detection systems are described and which include an intrusion detection panel that receives binary and metadata sensor data from which the presence of an alarm condition is detected. In addition sensor devices analyze sensor data received from other sensor devices that are in a peer to peer relationship with the corresponding sensor device to validate whether the indicated alarm condition is a valid alarm or a false alarm.

15 Claims, 9 Drawing Sheets

(56) References Cited

U.S. PATENT DOCUMENTS

2007/0262857 A1* 11/2007 Jackson ..... G08B 13/19656 340/506
2008/0007404 A1* 1/2008 Albert ..... G01S 5/0252 340/552
2008/0157964 A1* 7/2008 Eskildsen ..... G08B 13/08 340/545.1
2009/0022362 A1* 1/2009 Gagvani ..... G06T 7/2053 382/100
2009/0167862 A1* 7/2009 Jentoft ..... G08B 13/19641 348/143
2009/0195382 A1* 8/2009 Hall ..... G08B 13/19613 340/541
2009/0225166 A1* 9/2009 Dronge ..... G08B 13/194 348/155
2011/0001812 A1* 1/2011 Kang ..... G08B 13/00 348/77
2011/0169637 A1 7/2011 Siegler et al.
2011/0254680 A1* 10/2011 Perkinson ..... G08B 29/14 340/506
2011/0254681 A1* 10/2011 Perkinson ..... G08B 29/14 340/506
2011/0279259 A1* 11/2011 Jackson ..... G08B 13/19656 340/506
2012/0092158 A1* 4/2012 Kumbhar ..... G08B 15/00 340/539.13
2012/0188072 A1 7/2012 Dawes et al.
2013/0293718 A1* 11/2013 M ..... G08B 13/19669 348/152
2013/0314542 A1* 11/2013 Jackson ..... G08B 13/19656 348/156
2013/0321150 A1* 12/2013 Koenig ..... G08B 25/008 340/541
2014/0232861 A1* 8/2014 Naidoo ..... H04N 7/18 348/143
2015/0102922 A1* 4/2015 Witmer ..... G08B 13/00 340/527
2015/0172602 A9* 6/2015 Naidoo ..... H04N 7/18 348/143

* cited by examiner

FALSE ALARM AVOIDANCE IN SECURITY SYSTEMS FILTERING LOW IN NETWORK

BACKGROUND

This description relates to operation of security systems in particular intrusion systems.

It is common for businesses and homeowners to have a security system for detecting alarm conditions at their premises and signaling the conditions to a monitoring station or to authorized users of the security system. Security systems often include an intrusion detection panel that is electrically or wirelessly connected to a variety of sensors. Those sensors typically include motion detectors, cameras, and proximity sensors (used to determine whether a door or window has been opened). Typically, such systems receive a very simple signal (electrically open or closed) from one or more of these sensors to indicate that a particular condition being monitored has changed or become unsecure.

For example, typical intrusion systems can be set up to monitor entry doors in a building. When the door is secured, the proximity sensor senses a magnetic contact and creates an electrically closed circuit. When the door is opened, the proximity sensor opens the circuit, and sends a signal to the panel indicating that an alarm condition has occurred (e.g., an opened entry door).

SUMMARY

The problem with this type of intrusion system is that it is prone to false alarms. All that the panel can determine from the signals sent from the sensors is whether a door/window has been opened or whether motion has been detected within an area being monitored. The panel cannot determine any other condition associated with the occurrence of the condition. For example, while a heat-sensitive motion sensor could detect that a warm object has moved across the room, the motion sensor cannot detect whether that movement was caused by a human or a pet. As another example, the motion detector could detect that a warm object has moved across a window, however, the motion sensor cannot detect whether that object is inside or outside of the window. These limitations are significant causes of false alarms that can cost alarm monitoring companies, building owners, security professionals and police departments significant amounts of money and wasted time that would otherwise be spent on real intrusion situations.

According to an aspect, a sensor device includes, at least one event sensor element, a processor and memory in communication with the processor device, and a storage device that stores a program of computing instructions to receive sensor data from the at least event sensor element of the sensor device, analyze the received sensor data for the presence of an alarm condition, receive sensor data from at least one other sensor device that is in a peer to peer relationship with the sensor device to validate whether the indicated alarm condition is a valid alarm or a false alarm, send results of analyzed sensor data to the at least one other sensor device in the peer to peer relationship with the sensor device; and a network interface configured to communicate sensor data and alarm conditions to other sensor devices that are in a peer to peer relationship with the sensor device.

Aspects of the invention include computer program products tangible stored on a physical, hardware storage device or devices or systems as well as computer implemented methods.

The above techniques can include additional features and one or more of the following advantages.

The use of an analysis of the metadata by the intrusion detection panel would likely significantly reduce the rate of false alarms. Thus, minimizing costs borne by alarm monitoring companies, building owners, and security professionals, and better utilize police department resources to handle real intrusion situations. As all raw data comes from separate sensors on a single detection device the filter event declaration and in some instances from other enhanced sensor devices these data can be combined to define a "composite" or "complex" event signal that corresponds to a true alarm condition more dependably than would any one of the individual sensor events from the simple individual sensors, considered separately.

The details of one or more embodiments of the invention are set forth in the accompanying drawings and the description below. Other features, objects, and advantages of the invention is apparent from the description and drawings, and from the claims.

DETAILED DESCRIPTION

Figure 1:
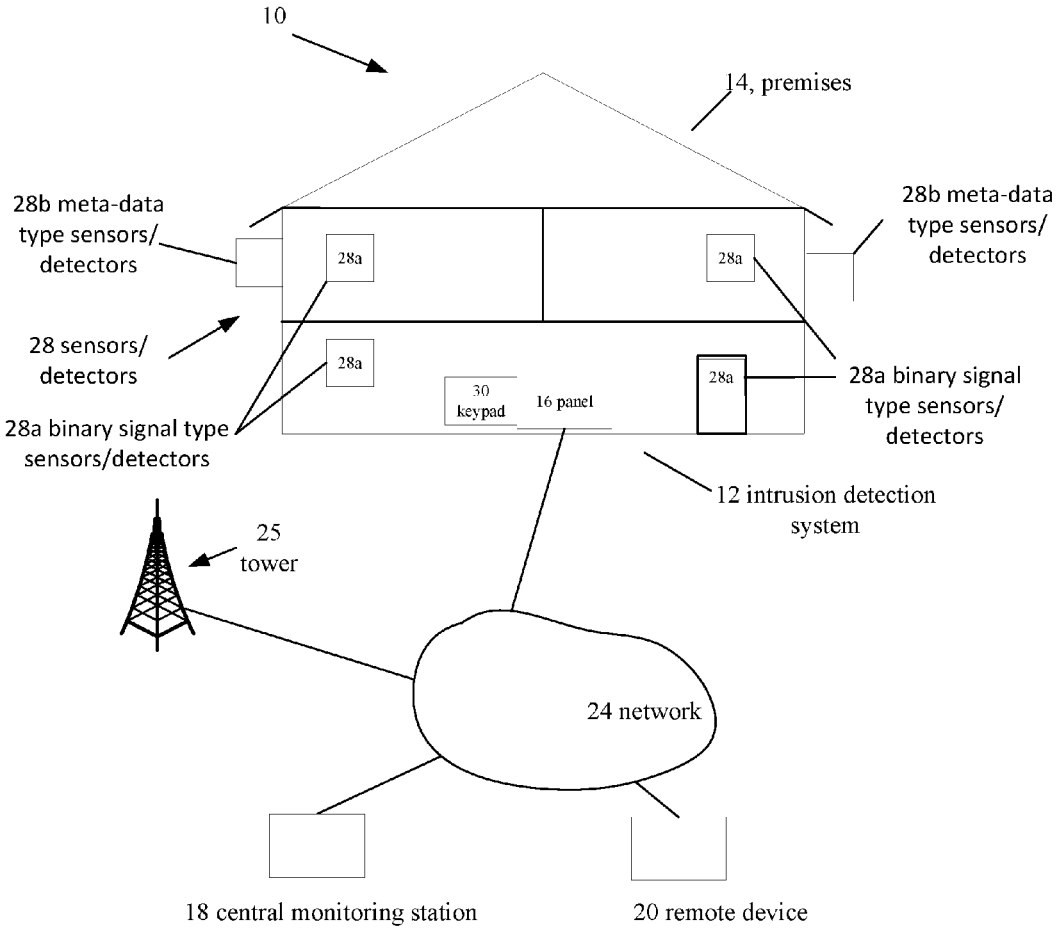
FIG. 1 is a schematic diagram of an example security system at a premises.

Referring now to FIG. 1 an example application 10 of a security system in particular an intrusion detection system 12 installed at a premises 14 is shown. In this example, the premises 14 is a residential house, but the premises may alternatively be any type of premises or building, e.g., commercial, industrial, etc. The intrusion detection system 12 includes an intrusion detection panel 16, and sensors/detectors 28 disbursed throughout the premises 14. The intrusion detection system 12 is in communication with a central monitoring station 18 (also referred to as central monitoring center) via one or more data or communication networks 24 (only one shown), such as the Internet; the phone system or cellular communication system being examples of others. The intrusion detection panel 16 receives signals from plural detectors/sensors (generally referred to as 28) that send to the intrusion detection panel 16 information about the status of the monitored premises.

Several types of sensor/detectors (unless otherwise noted are used interchangeably herein) are used. One type 28*a* of detector is a detector that sends a binary signal that indicates presence or absence of an event. Examples of these types of detectors 28*a* include glass break detectors and contact switches. Another type 28*b* of detector is a detector that sends metadata that includes data resulting from processing applied by the detector to inputs received by the sensor. Examples of these types of detectors 28*b* include microphones, motion detectors, smart switches and cameras.

The detectors 28 may be hard wired to the intrusion detection panel 16 or may communicate with the intrusion detection panel 16 wirelessly. In general, detectors 28*a* sense glass breakage, motion, gas leaks, fire, and/or breach of an entry point, and send the sensed information to the intrusion detection panel 16. Based on the information received from the detectors 28*a*, the intrusion detection panel 16 determines whether to trigger alarms, e.g., by triggering one or more sirens (not shown) at the premise 14 and/or sending alarm messages to the monitoring station 18.

A user may access the intrusion detection panel 16 is accessed to control the intrusion detection system, e.g., disarm the intrusion detection system, arm the intrusion detection system, enter predetermined standards for the intrusion detection panel 16 to trigger the alarms, stop the alarms that have been triggered, add new detectors, change detector settings, view the monitoring status in real time, etc. The access can be made directly at the premise 14, e.g., through a keypad 30 connected to the control panel. In some implementations, the intrusion detection panel 16 through a remote device 20 and in those implementations, the intrusion detection panel 16 can also send alarms to the remote device 20. The arm/disarm user interfaces can include such interaction as one button arming and passive/proximity/RFID/SmartCard/etc. disarming. The arm/disarm user interfaces should be simple to use as authorized user interaction with more complex arm/disarm interfaces is one of the more significant sources of false alarms.

The data or communication network 24 may include any combination of wired and wireless links capable of carrying packet and/or switched traffic, and may span multiple carriers, and a wide geography. In one embodiment, the data network 24 may simply be the public Internet. In another embodiment, the data network 24 may include one or more wireless links, and may include a wireless data network, e.g., with tower 25 such as a 2G, 3G, 4G or LTE cellular data network. The panel 16 may be in communication with the network 24 by way of Ethernet switch or router (not illustrated). The panel 16 may therefore include an Ethernet or similar interface, which may be wired or wireless. Further network components, such as access points, routers, switches, DSL modems, and the like possibly interconnecting the panel 16 with the data network 24 are not illustrated.

Figure 2:
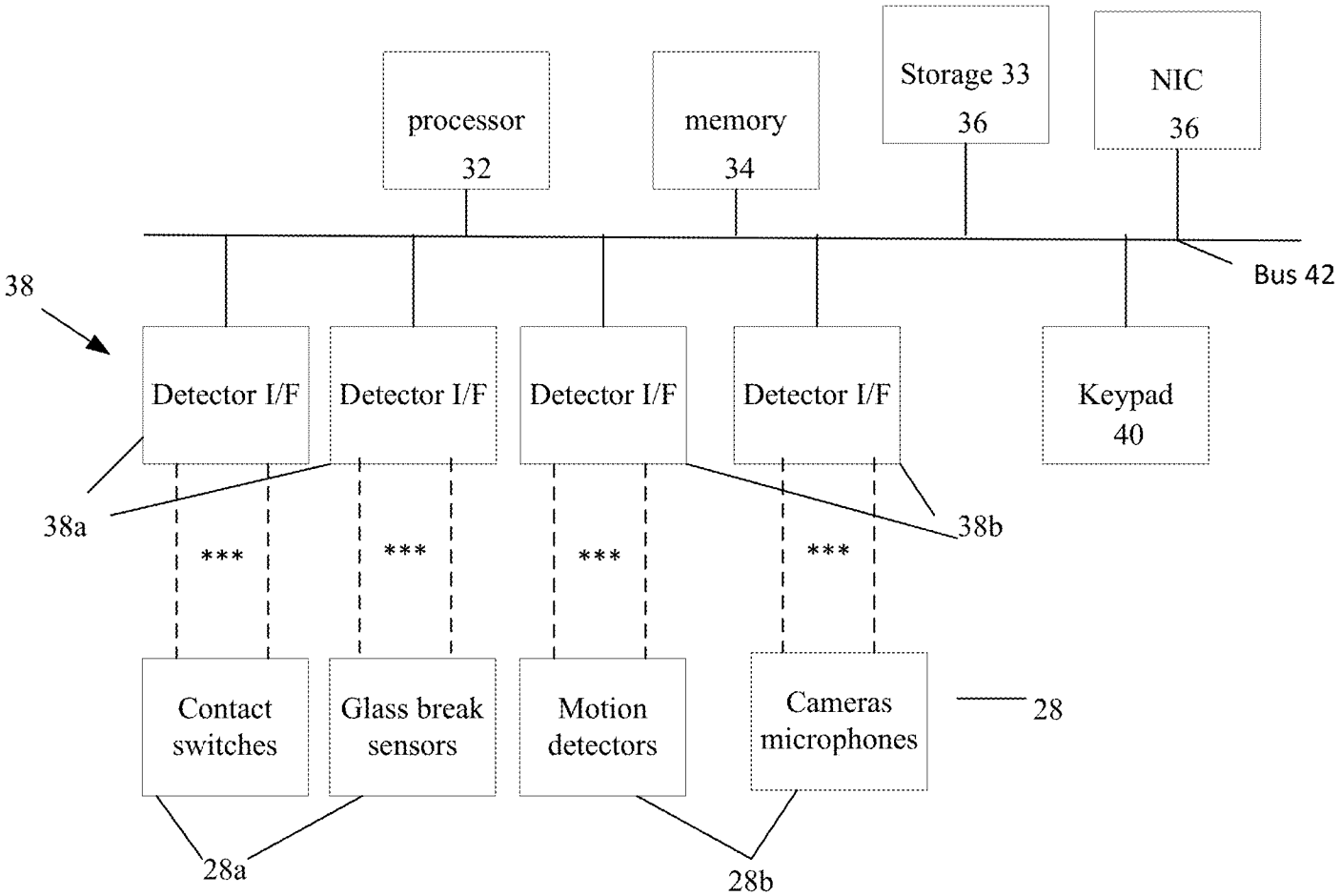
FIG. 2 is a block diagram of an intrusion detection panel system.

Referring now to FIG. 2, details on an exemplary intrusion detection panel 16 are shown. The intrusion detection panel 16 includes processor 32 and memory 34, storage 33, a key pad 40 and a network interface card (NIC) 36 coupled via a bus 42. The intrusion detection panel 16 also includes one or more interfaces 38 to receive sensor data from the various sensors 28. Illustrated for explanatory purpose are detector interfaces 38*a* for contact switches, glass break sensors that are exemplary of sensor types 28*a*, as well as detector interfaces 38*b* for motion detectors, cameras and microphones that are exemplary of sensor types 28*b*. The detector interfaces 38 are illustrated as grouped according to type of detector, however other configurations are possible. The sensors 28 can be coupled to the interfaces either via hard wiring or wirelessly as mentioned above.

Figure 3:
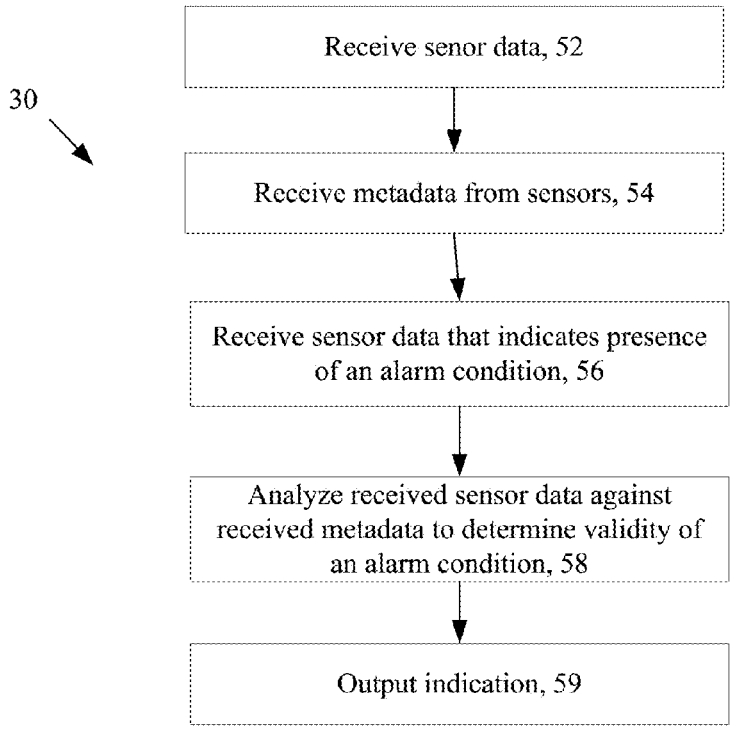
FIG. 3 is a flow diagram showing an example process for determining an alarm condition.

Referring now to FIG. 3, intelligent processing 50 by the intrusion detection system is shown. The intrusion detection panel receives 52 signals from various sensors of type 28*a*, e.g., glass break detectors and contact switches and receives 54 metadata from sensors of type 28*b*, e.g., a camera, a recording device, enhanced motion detectors, and microphones, etc. At some point the intrusion detection panel receives 56 signals from one or more sensors of type 28*a*, which indicates an event.

The intrusion detection panel analyzes 58 the received sensor data 32 and received metadata 54 to determine whether the received alarm condition is truly an alarm condition. According to the analysis the intrusion detection panel 16 may output an indication of an event.

Typically, for sensors such as glass break detectors and contact switches these signals are discrete, i.e., binary signals that indicate either the presence of a condition or the absence of the condition. When the intrusion detection panel 16 receives one of these signals from glass break detectors and contact switches that indicate the presence of a condition that signal is analyzed along with metadata received from one or more other sensor signals received by the intrusion detection panel 16. According to some embodiments, based on the analysis, the intrusion detection panel outputs 39 a signal according to whether the intrusion detection panel determines that it received a valid sensor signal that indicates an alarm or whether it received an occurrence of a false alarm condition. The intrusion detection panel 16 thus aggregates received sensor data from various sensor types in a manner that minimizes occurrences of false alarms.

In other embodiments, discussed below, the analysis could be performed by a remote device. In those embodiments, the intrusion detection panel 16 passes the signal and metadata to the remote device for processing.

For example, using conventional perimeter and interior intrusion detection, the intrusion detection panel receives signals from sensor types 28*a* (i.e., binary) motion sensor signals indicating that there has been motion in a room, the intrusion detection panel also checks to see if contact sensors for doors or windows are also indicating that one or both have been opened. If there has been no intrusion through a door or window, but the motion sensor is triggered then this is likely a false alarm occurrence and an alarm state would not be initiated or, alternatively, an alert message would be communicated to a system user for final confirmation of whether an alarm state should be initiated. This situation could occur when a pet is moving within the room or if a person walks past a glass window or door. Similarly, if a window or door sensor indicates that one or both have been opened yet the motion sensor does not detect any motion in the room, this is also a likely false alarm occurrence. This situation could occur when a door or window is blown open by the wind or if a proximity sensor is failing. These are only two examples of many false alarm situations that can be identified by the panel's analysis of the data being provided by various sensors.

The intrusion detection panel 16 also receives metadata from other sensors, i.e., sensor types 28*b*, and using the metadata from those sensors determines if in fact there was an improper intrusion. Sensor types 28*b* perform a significant amount of analysis and send metadata to the panel representing the results of that analysis.

As used herein metadata is defined as data that conveys results of processing of inputs by sensor types 28*b*, where this defined data includes characteristics of an object or other feature detected by the sensor types. The metadata comprises information/data that conveys a state of an area within the range of sensors of the sensor type 28*b*. This information can be among other things, information that delineates approximate or exact object size, position, speed, identity of an individual detected or the lack of identity of an individual detected, etc.

The sensors provide in addition to an indication that something is detected in an area within the range of the sensors, detailed additional information that can be used to evaluate what that indication may be without the intrusion detection panel 16 being required to perform extensive analysis of inputs to the particular sensor. The received metadata is analyzed by the intrusion detection panel 16 to discriminate true alarm conditions from false alarm occurrences.

By analyzing metadata from the sensor types 28*b* the sensor rather than the intrusion detection panel 16 performs much of the analysis on inputs received at the particular sensor, and sends the results of that analysis as metadata to the intrusion detection panel 16. The intrusion detection panel 16 uses that metadata in combination with conventional perimeter and interior intrusion detection as well as metadata from other sensors of the sensor type 16*b* to verify existence of an alarm condition.

For example, a motion detector could be configured to analyze the heat signature of a warm body moving in a room to determine if the body is that of a human or a pet. A metadata representation of the result of that analysis would be a message or data that conveys information about the body detected. For example, the signal could be a message that details size or shape, etc. of that warm body that can be used to indicate that the body is too small to be a human. This metadata is sent to the intrusion detection panel 16 along with metadata from other sensors. The intrusion detection panel analyzes 58 the metadata to validate whether the received indication from one or more of the sensor types 28*a* actually represents a valid event or whether it represents a false alarm occurrence. Various sensors thus are used to sense sound, motion, vibration, pressure, heat, images, and so forth, in an appropriate combination to detect a true or verified alarm condition at the intrusion detection panel. The intrusion detection panel evaluates the metadata and outputs from all sensors in a logical manner with respect to each other, and the environment, to make an intelligent decision as opposed to just transferring a sensor input to a signal output. This will reduce the occurrences of false alarms minimizing the number of false alarms that are sent to the central monitoring station.

Figure 4:
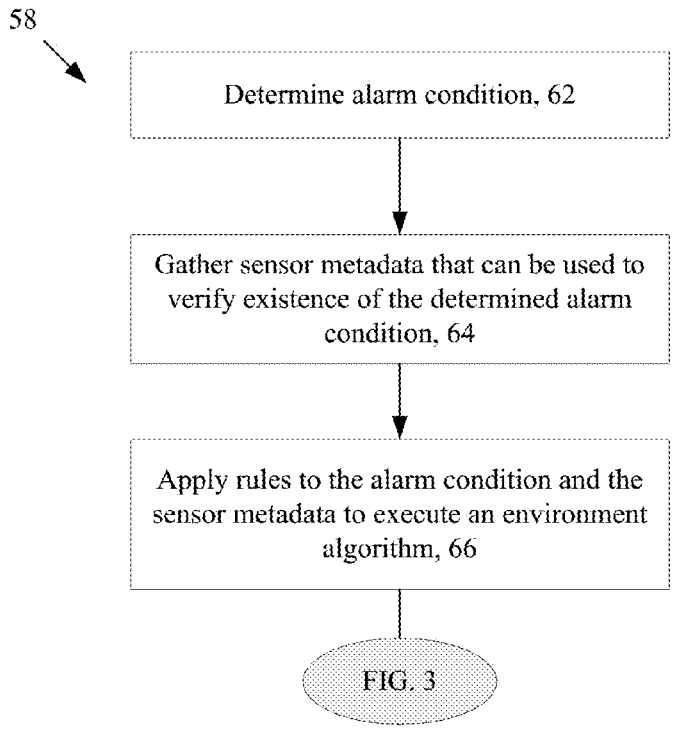
FIG. 4 is a flow diagram of an analysis process.

Referring to FIG. 4, an exemplary analysis 58 performed by the intrusion detection panel 16 is shown. The intrusion detection panel 16 receives the various sensor signals, as in FIG. 3. The intrusion detection panel 16 determines 62 what condition has been asserted typically from one or more of the sensor types 28*a* asserting an entry into the premises 14. Either the intrusion detection panel 16 or individual sensors, apply appropriate logic to execute various sensor algorithms that analyze inputs to other sensors such as sensor types 28*b* disposed within the environment. In any event, the intrusion detection panel 16 gathers 64 sufficient environmental information pertinent to the asserted condition. In some implementations the gather data includes all available environmental information. The metadata from the sensors (or intrusion detection panel) along with outputs from sensor types 28*a* are used in execution of an environmental algorithm 66 that forms a decision regarding intrusion.

Figure 5:
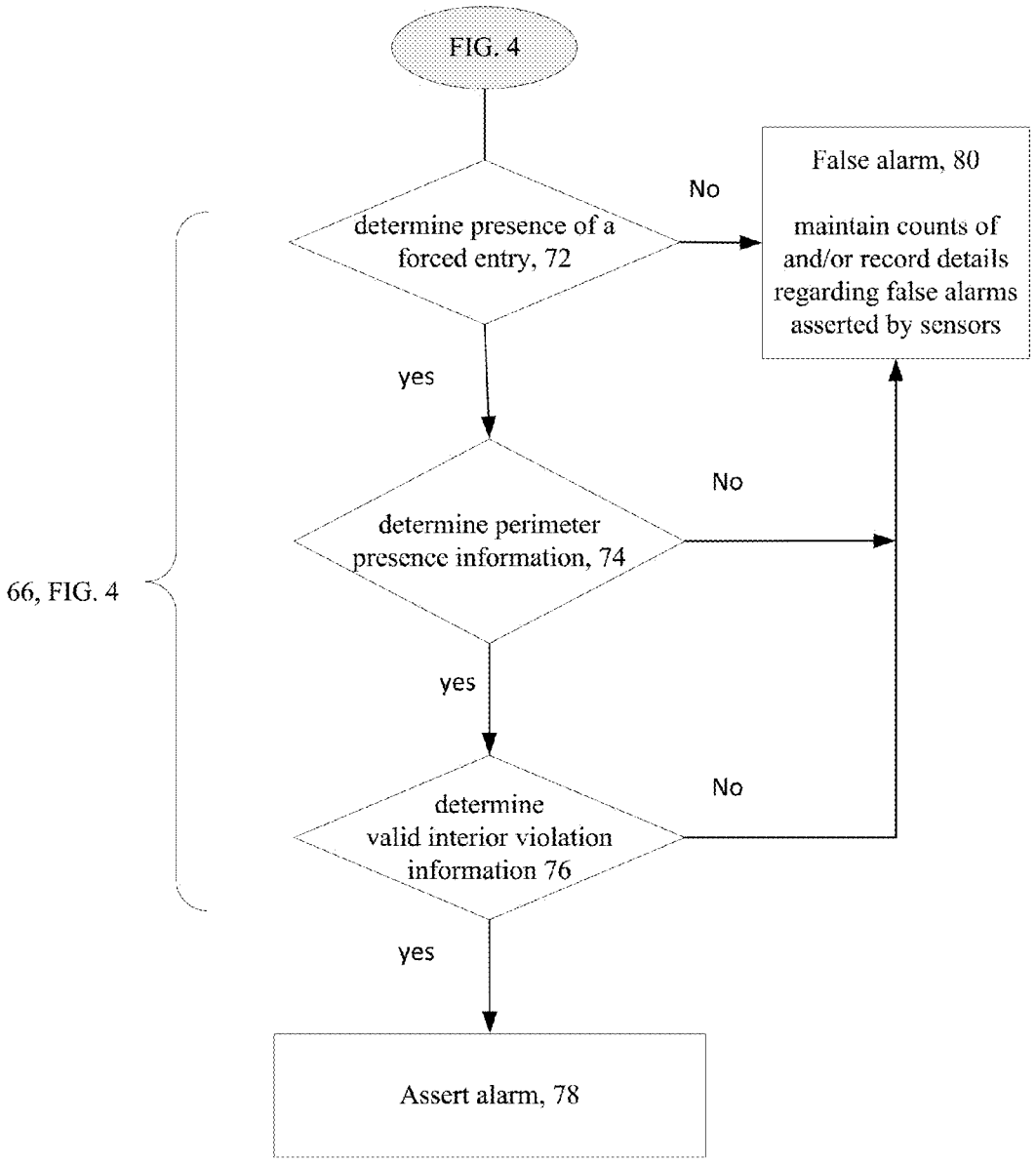
FIG. 5 is a flow diagram of an example environmental algorithm.

Referring now to FIG. 5, an exemplary environmental algorithm is:

Forced entry+Perimeter presence+Valid interior violation=Verified alarm condition Applying rules 66 (FIG. 4) involves determining 72 presence of a forced entry. A forced entry into the premises is determined by receipt of one or more indications from the sensor types 28*a*, which indicate whether there is was a potential intrusion into the premises.

Applying rules 66 (FIG. 4) also involves determining 74 perimeter presence information regarding detected objects from the various sensors. This information is gathered from sensors disposed external to the premises, such as conventional or enhanced motion detectors, video cameras, microphones and/or other sound capturing devices. Generally, the information is in the form of metadata, e.g., the results of processing at the sensors inputs to the various sensors of sensor type 28*b*. The perimeter presence information can be relatively simple information such as existence of a perimeter intrusion by an object, details regard the time of the intrusion and information regarding the size, speed, etc. of the object that caused the perimeter intrusion to more complex information such as indicating a perimeter intrusion based on characteristics of the intruder.

For example, recognition software can be used to discriminate between objects that are a human and objects that are an animal; further facial recognition software can be built into video cameras and used to verify that the perimeter intrusion was the result of a recognized, authorized individual. Such video cameras would comprise a processor and memory and the recognition software to process inputs (captured images) by the camera and produce the metadata to convey information regarding recognition or lack of recognition of an individual captured by the video camera. The processing could also alternatively or in addition include information regarding characteristic of the individual in the area captured/monitored by the video camera. Thus, depending on the circumstances, the information would be either metadata received from enhanced motion detectors and video cameras that performed enhanced analysis on inputs to the sensor that gives characteristics of the perimeter intrusion or a metadata resulting from very complex processing that seeks to establish recognition of the object.

Applying rules 66 (FIG. 4) also involves determining 76 valid interior violation information from various sensors within the premises. This information is gathered from simple sensors disposed internal to the premises, such as conventional or enhanced motion detectors, video cameras, webcams, and microphones and/or other sound capturing devices. Generally, the information is in the form of either a binary signal for sensor types 28*a* or metadata, e.g., the results of processing sensors inputs to sensor types 28*b*. The valid interior violation information can be relatively simple information such as presence of a body in the premises to more complex information such as characteristics of the body, e.g., recognition software built into video cameras. Thus, depending on the circumstances, the information would be either a binary signal (open/close, or a pattern or code, etc.) indication of the presence or absence of a perimeter intrusion, which would be received from conventional motion detectors and video cameras or a more complex metadata signal received from enhanced motion detectors and video cameras that performed enhanced analysis on inputs to the sensor that gives characteristics of the perimeter intrusion.

When the processor in the intrusion detection panel 16 determines existence of a forced entry 72, presence of an individual at the perimeter of the premises 74, and presence of an individual within the area of the premises 76, the intrusion detection panel 16 considers this as an intrusion. The intrusion detection panel 16 asserts an alarm 78, which could be sounding an external/internal alarm and/or sending a message to the monitoring center. In some embodiments, if any one or more of the sensors fail to assert existence of the conditions 72, 74 and 76 mentioned above, then the intrusion detection panel 16 determines 80 that there was a false alarm.

When the intrusion detection panel 16 determines 80 that there was a false alarm, the intrusion detection panel 16 in some embodiments maintains counts of and/or records details regarding the false alarm asserted by the one or more sensors. As these counts and details accumulate, the intrusion detection panel 16 can be configured to send information regarding these false alarms to the monitoring station (or another station) for maintenance purposes. For example, for each false alarm the intrusion detection panel 16 records the date and time, and sensors that were used in the evaluation and the outputs recorded by each of the sensors.

The environmental intrusion detection algorithm is executed at the intrusion detection panel. The intrusion detection panel 16 gathers and stores sufficient environmental information, and applies appropriate logic through execution of algorithms that analyze the environment according to the conditions above. For the forced entry element of the above equation sensors such as convention contact switches and glass break sensors send sensor signals to the panel for analysis. For the perimeter presence element of the above equation sensors such as video camera are used to discover over a period of time whether there were any perimeter intrusions. Video cameras can forward frame data to the panel for analysis, or alternatively, the analysis can be built into the video cameras. Such devices integrate image detectors or video capture "like" devices with other sensors that provide a data stream output. For the valid interior violation element of the above equation sensors such as simple web cams that are placed in the interior of a premises supply information that verifies presence of a body within the premises. The environmental intrusion detection algorithm uses combinations of existing security sensors with binary outputs and other sensors with more complex outputs together to arrive at a decision on whether to assert an alarm condition. When the environmental intrusion detection algorithm is satisfied, the intrusion detection panel 16 will assert an alarm, such as sounding an alarm and/or sending a message to a central monitoring system.

Sensor devices can integrate multiple sensors to generate more complex outputs so that the intrusion detection panel can optimally utilize its processing capabilities to execute algorithms that thoroughly analyze the environment by building virtual images or signatures of the environment to make an intelligent decision about the validity of a breach.

The memory 34 stores program instructions and data used by the processor 60 of the intrusion detection panel 16. The memory 34 may be a suitable combination of random access memory and read-only memory, and may host suitable program instructions (e.g. firmware or operating software), and configuration and operating data and may be organized as a file system or otherwise. The stored program instruction may include one or more authentication processes for authenticating one or more users by the intrusion detection panel 16 before granting the users with accesses to a security system that includes the intrusion detection panel 16.

The program instructions stored in the memory 34 of the panel 16 may further store software components allowing network communications and establishment of connections to the data network 24. The software components may, for example, include an internet protocol (IP) stack, as well as driver components for the various interfaces, including the interfaces 38 and the keypad 30. Other software components suitable for establishing a connection and communicating across network 24 will be apparent to those of ordinary skill.

Program instructions stored in the memory 34 of the intrusion detection panel 16, along with configuration data may control overall operation of the panel 16. In particular, program instructions control how the panel 16 may grant a user with a certain level of access to a security system, how the panel 16 may be transitioned between its armed and disarmed states, and how the panel 16 reacts to sensing conditions at detectors 28 that may signify an alarm. Moreover, one or more data network addresses for signaling alarm conditions may be stored in the memory 62 of the intrusion detection panel 16. These network addresses may include the network addresses (e.g. IP) by which the monitoring station 18 may be reached. Example control panels may comprise DSC® models PC2864 and PC9155, SCW915x suitably modified to operate as described herein.

Figure 6:
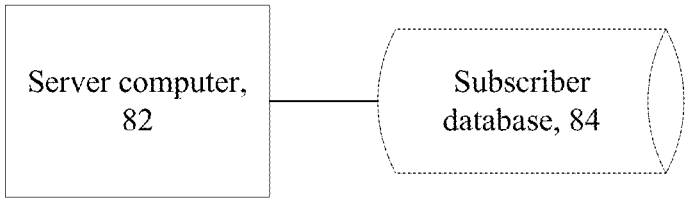
FIG. 6 is a schematic block diagram showing part of an example monitoring station.

An example monitoring station 18 is shown in FIG. 6. The monitoring station 18 is depicted as a single physical monitoring station or center in FIG. 1. However, it could alternatively be formed of multiple monitoring centers/stations, each at a different physical location, and each in communication with the data network 24. The central monitoring station 18 includes one or more monitoring server(s) 82 each processing messages from the panels 16 and/or user devices (not shown) of subscribers serviced by the monitoring station 18. Optionally, a monitoring server 82 may also take part in two-way audio communications or otherwise communicate over the network 24, with a suitably equipped interconnected panel 16 and/or user device (not shown).

The monitoring server 82 may include a processor, a network interface and a memory (all not illustrated). The monitoring server 82 may physically take the form of a rack mounted card and may be in communication with one or more operator terminals (not shown). An example monitoring server 82 is a SURGARD™ SG-System III Virtual, or similar system.

The processor of each monitoring server 82 acts as a controller for each monitoring server 82, and is in communication with, and controls overall operation, of each server 82. The processor may include, or be in communication with the memory that stores processor executable instructions controlling the overall operation of the monitoring server 82. Suitable software enable each monitoring server 82 to receive alarms and cause appropriate actions to occur. Software may include a suitable Internet protocol (IP) stack and applications/clients.

Each monitoring server 82 of central monitoring station 18 may be associated with an IP address and port(s) by which it communicates with the control panels 16 and/or the user devices to handle alarm events, etc. The monitoring server address may be static, and thus always identify a particular one of monitoring server 32 to the intrusion detection panels. Alternatively, dynamic addresses could be used, and associated with static domain names, resolved through a domain name service.

The network interface may be a conventional network interface that interfaces with the network 24 (FIG. 1) to receive incoming signals, and may for example take the form of an Ethernet network interface card (NIC). The servers may be computers, thin-clients, or the like, to which received data representative of an alarm event is passed for handling by human operators. The monitoring station 18 may further include, or have access to, a subscriber database 84 that includes a database under control of a database engine. Database 84 may contain entries corresponding to the various subscribers to panels like the panel 16 that are serviced by the monitoring station 18.

Figure 7:
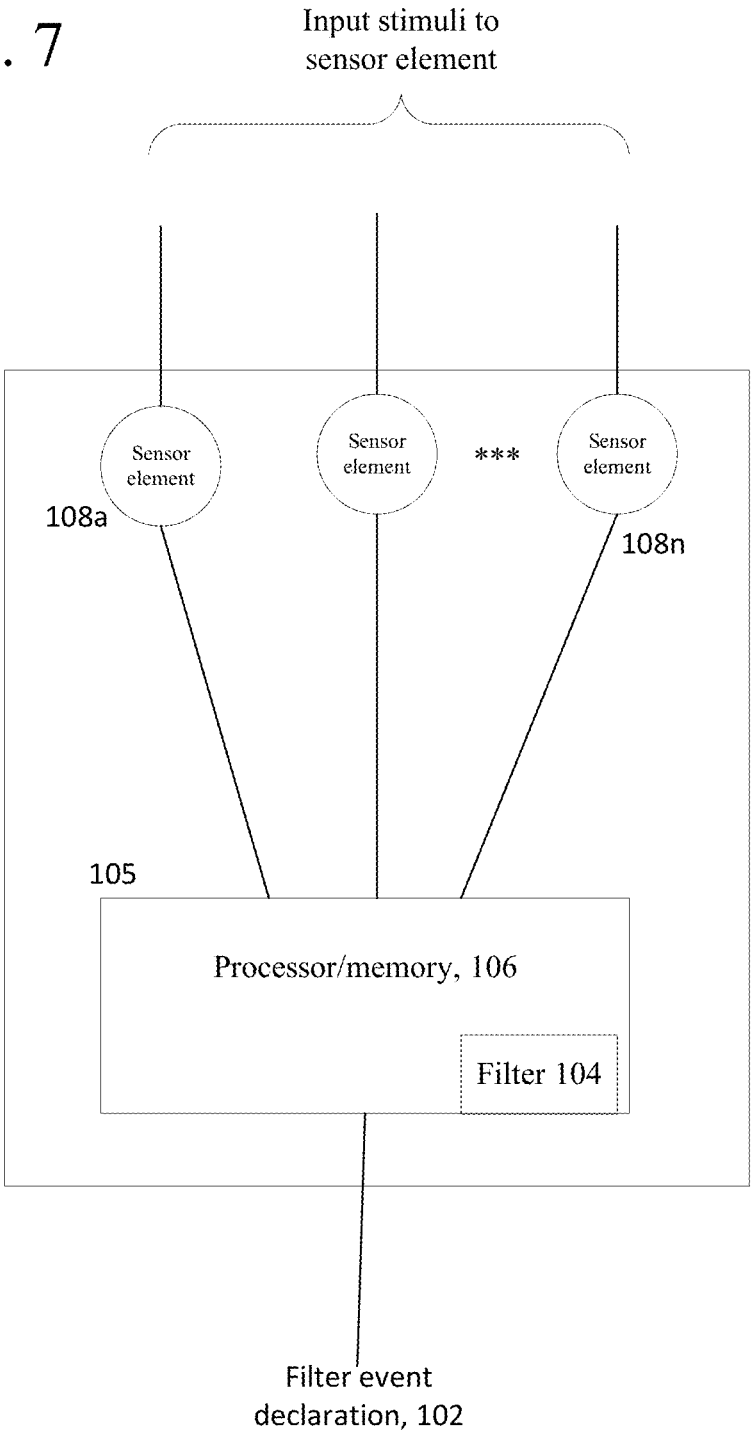
FIG. 7 is a block diagram showing an example composite sensor device.

Referring now to FIG. 7, an enhanced sensor device 100 is shown. The enhanced sensor device 100 produces a filter event declaration 102 from information received from sensors elements 108*a*-108*n* in which a filter 105 (e.g., software 104 running on the enhanced sensor processing device/memory 106) executes a set of mathematical functions and transformations on combinations of raw sensor data from the sensor elements and/or metadata characteristics produced by the sensor elements 108*a*-108*n*. The enhanced sensor 100 produces the filter event declaration 102 by examining the raw sensor data and/or metadata over time intervals, and in particular based on an order of arrival of the raw data collected from the multiple sensing elements 108*a*-108*n* on the enhanced sensor device 100. These data are sent as input to the filter/processor 105 providing in effect a composite or virtual sensor. The software filter 104 output operates in a binary mode (e.g., the combined outputs of the collection of simple sensors are inputted to the filter 104 and the result of the analysis is a determination of whether or not the result from the filter 104 has a value that exceeds a preconfigured threshold value.

This embodiment is distinct from filters that run on the detection panel 16 (FIG. 1), as discussed above, and which receive inputs from separate sensor devices. In this embodiment, all raw data comes from separate sensor elements (or from a sensor over time) on a single detection device 100. Alternatively, filtering can be performed in multiple layers, that is some filtering can occur at the enhanced sensor device 100 and some filtering at the detection panel 16.

The filter event declaration 102 produced from the enhanced sensor device can be combined by the processor executing the filter to define a "composite" or "complex" event signal (composite filter event declaration) that corresponds to a true alarm condition more dependably than would any one of the individual sensor events from the simple individual sensors, considered separately. The filter 105 can be placed on the detection panel 16 or in a server, and raw data inputted to the filter can come from multiple sensors of various types in the network.

Figure 8:
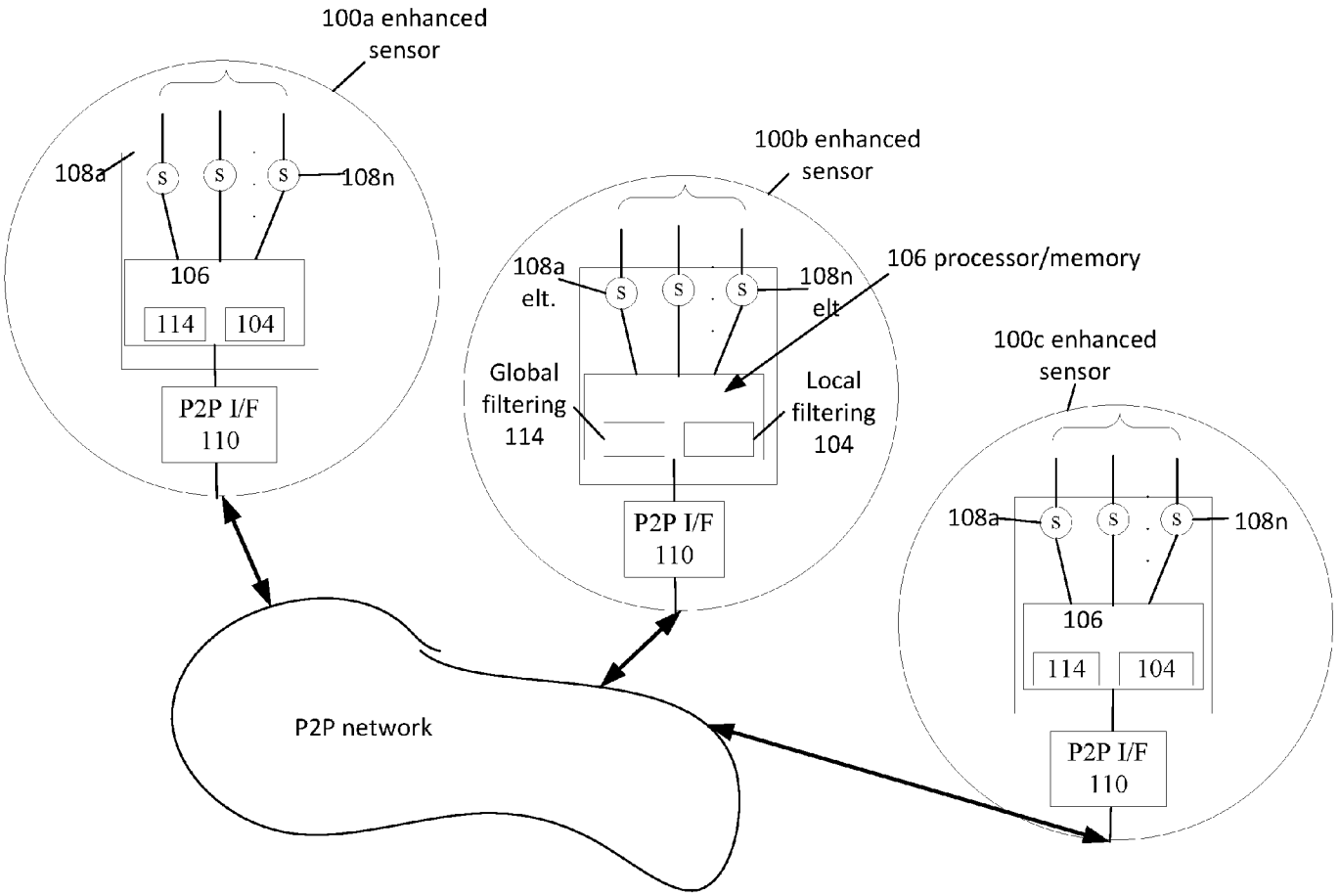
FIG. 8 is a block diagram depicting a network of sensor devices.

Referring now to FIG. 8, a plurality of an enhanced sensor devices 100*a*-100*c* is shown. These an enhanced sensor devices 100*a*-100*c* are similar to enhanced sensor device 100 (FIG. 7), but include a global filter as part of the filter device 105 (filter 104 and processor memory 106 from FIG. 7) shown placed lower in a detection network, e.g., on individual devices that have multiple on-board sensors.

As shown in FIG. 8, the individual enhanced sensor devices 100*a*-100*c* (collectively referred to as sensor nodes 100*a*-100*c*) are in communication over a distributed network, e.g., wire or wireless. Each of the individual sensor nodes 100*a*-100*c* include respective processors/memory 106 and corresponding local filter 104 and a global filter 114. The processors/memories 106 use both local filters 104 and global 114 filters. The local filters 104 filter the raw data from individual nodes, locally, and communicate filter states or "filter events" to corresponding global filter 114 of the other nodes directly in a peer-to-peer fashion, via the P2P interfaces 110 without sending these filter events to the detection panel 16.

Any node in a pre-defined set of nodes is in mutual communication with other nodes. In the context of this embodiment, a peer-to-peer (P2P) network is a type of decentralized and distributed network where the individual nodes act as both suppliers and consumers of resources, in contrast to a centralized client—server situation, e.g., where nodes request access to resources provided by the detection panel 16. In the peer-to-peer network, filtering tasks are shared among the various sensors that are interconnected peers, and which provide data and in some instances processing power, storage etc. directly to other peer sensors, without the need for centralized coordination by the detection panel 16 or control center. Such sensor nodes 100*a*-100*c* therefore can consider not only its local filter state from the filter 104, but also a global filter state from global filtering 114 performed by the other filters in other sensor nodes 100*a*-100*c* when determining the presence/absence of a composite filter event declaration.

For example, as shown in FIG. 8, three enhanced sensor devices 100*a*-100*c*, each with single sensors—a heat-sensitive motion sensor, a door switch, and a video camera are each equipped with a wireless sensor network node (processor and wireless interface). In other embodiments, the three enhanced sensor devices 100*a*-100*c* can each have a heat-sensitive motion sensor, a door switch, and a video camera and have a local filter that examines data coming from each of the sensor elements and a global filter that examines data from the other devices. Firmware running on each enhanced sensor device's processor is configured such that when a local filter fires (goes from 0 to 1 state), the filter communicates this occurrence directly, via messages transmitted over local network 112, e.g., a wireless network, to the other sensor nodes 100*a*-100*c* in the 3-node set shown. If two (or all three) of the nodes experience corresponding local filter events, one of the three nodes will recognize this corroboration (via the peer-to-peer wireless messaging) and the global filter will be fired by that node. When the global filter fires this occurrence of the local filter events is sent to the composite filter event declaration.

This approach to multi-sensor data filtering has certain advantages over centralized (panel based) filtering in that the panel may be some distance from the (relatively localized) set of nodes. Peer-to-peer messaging is fast, whereas communication back to the detection panel 16 may involve multiple hops of the message through the wireless network. Such time latency can be detrimental to capturing video images of an event. The peer-to-peer approach provides relatively low latency and thus enables better capture of video/images. Such distributed filtering also adds redundancy and robustness to the network (e.g., the message of the complex filter event can be sent to multiple panels/web gateways/IP addresses. This would be especially important for certain types of detections such as in a building that might be on fire, or in situations where one panel may have been deliberately disabled by an intruder).

The local filters can be tuned over time using pattern recognition to show which local events correlate with which other local events. This could best be done in the panel or remote server, and the positive correlations used to help decide which nodes to place in direct (peer-to-peer) communication with each other.

The filter/processor 105 can also process metadata to determine a level of awareness that is communicated to the monitoring station 18. Several different levels of awareness would be provided. The levels can be fixed within a particular system or the levels can be end-user defined levels. When user-defined a user can use a user, e.g., graphical user interface to define the particular levels. The levels are of successively increasing levels of concern or risk, typically with the highest level being an assertion of an alarm. For example, there can be five (5) user assignable levels of "awareness" as discussed below.

1=A point of protection was tripped, but nothing to worry about

2=watch—suspicious activity may be occurring

3=warning—out of policy activity has occurred

4=eminent threat of a breach

5=breach has occurred, emergency responders have been notified

These are but examples. Further, the different parameters for each of these levels can be programmable.

Figure 9:
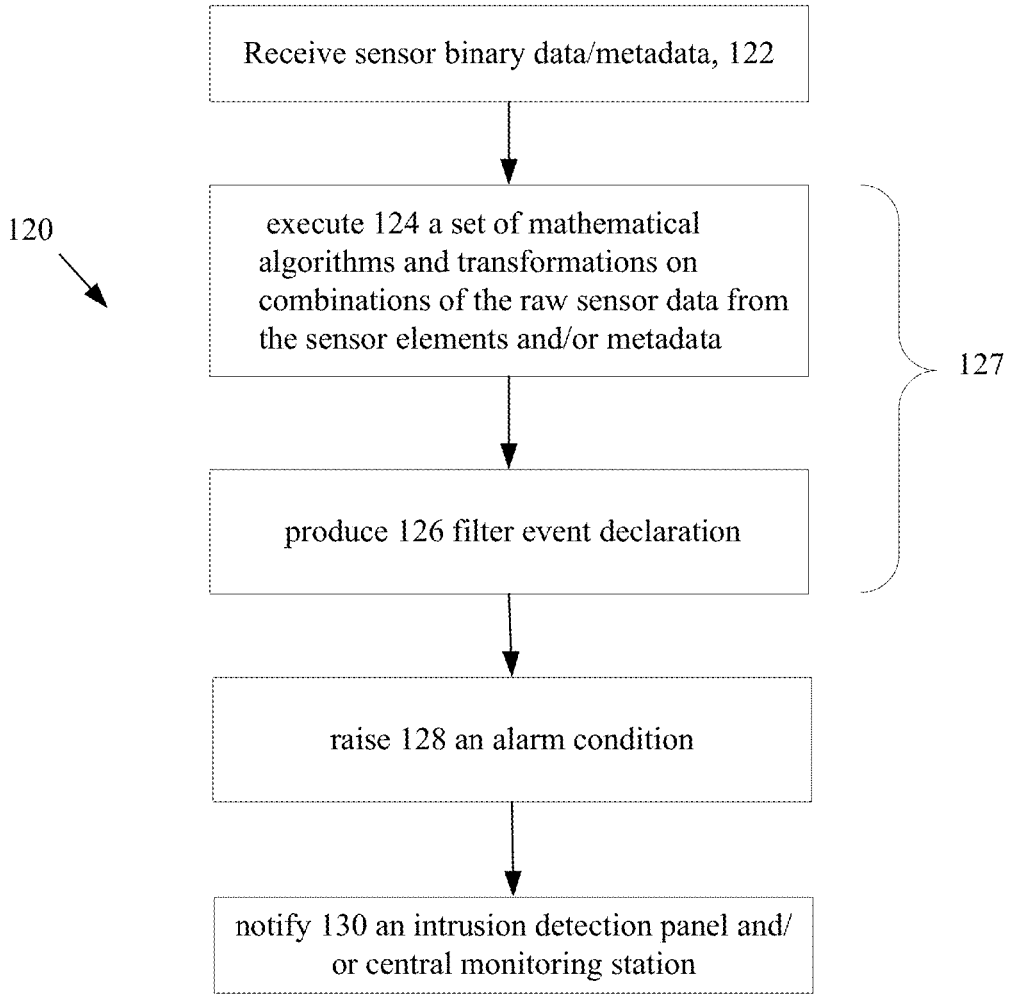
FIGS. 9 and 10 are flowcharts depicting processing on the sensor devices.

Referring now to FIG. 9, the enhanced sensor device 100 is configured to produce 120 a filter event declaration, as shown. The enhanced sensor device 100 receives 122 information from sensors elements 108*a*-108*n*. The filter 105 executes 124 a set of mathematical algorithms and transformations on combinations of the raw sensor data from the sensor elements and/or metadata produced by the sensor elements 108*a*-108*n*, as appropriate, and produces 126, the filter event declaration 102 (collectively 124 and 126 referred to as processing 127). Depending on the execution of the algorithms, the enhanced sensor device will raise 128 an alarm condition and notify 130 an intrusion detection panel and/or central monitoring station.

Figure 10:
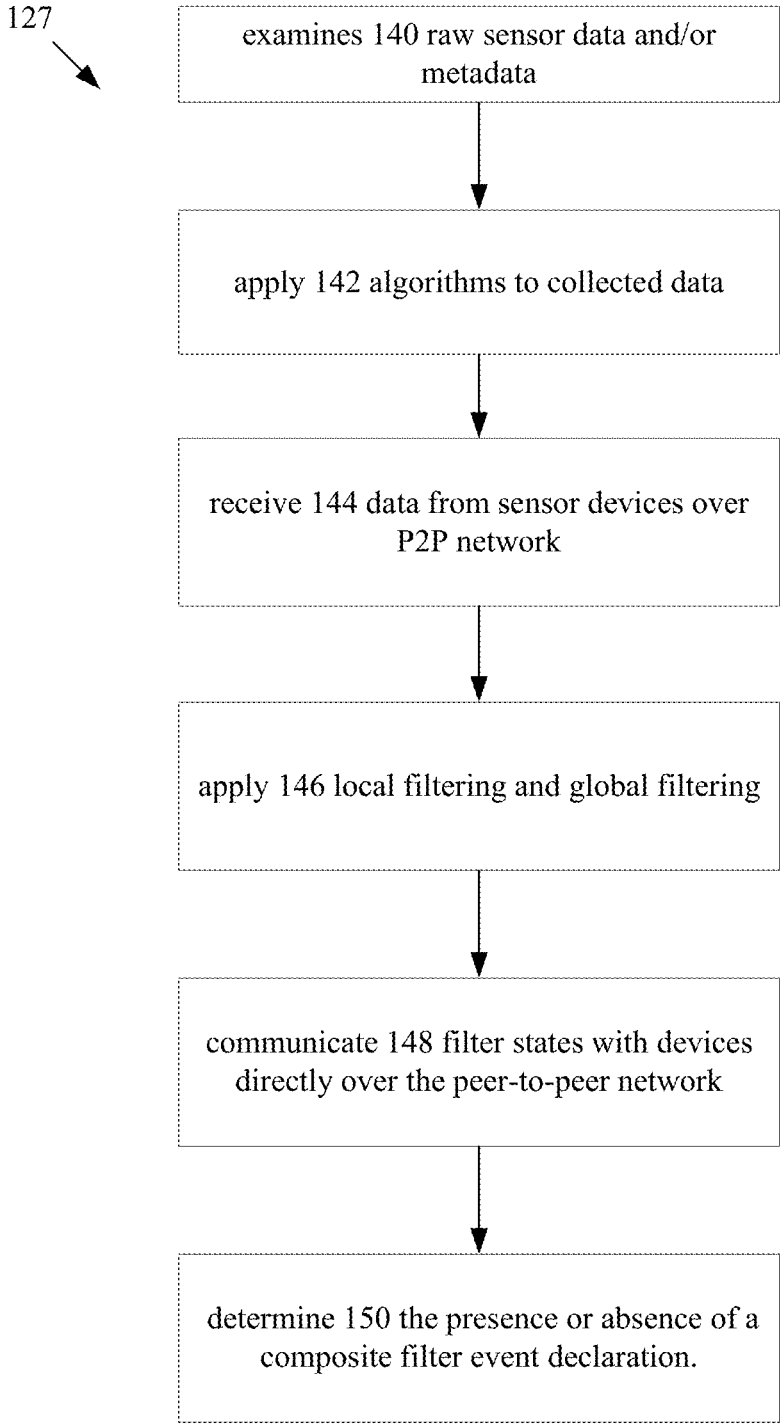

Referring now to FIG. 10, processing 127 is shown in more detail. The enhanced sensor device 100 examines 140 the raw sensor data and/or metadata over time intervals, and applies 142 algorithms such as an order of arrival algorithm as collected from the multiple sensing elements 108*a*-108*n* on the enhanced sensor device 100. The enhanced sensor device 100 also receives 144 data from sensor devices as in FIG. 8 over the P2P network. The sensor device 100 applies 146 the local filter and global filter to filter the raw data from sensor device 100 and from others of the individual sensor devices and communicates 148 filter states or "filter events" with each other directly over the peer-to-peer network. The sensor device 100 processes the information based on the local filter state and the global filter state from filtering performed by other filters in other enhanced sensor devices. Based on the processing using the local and global filters, the enhanced sensor device 100 determines 150 the presence or absence of a composite filter event declaration, which can be used to raise an alarm 128 (FIG. 9) and/or notify 130 (FIG. 9) an intrusion detection panel and/or central monitoring station, as appropriate.

Servers can be any of a variety of computing devices capable of receiving information, such as a server, a distributed computing system 10, a rack-mounted server and so forth. Server may be a single server or a group of servers that are at a same location or at different locations. Servers can receive information from client device user device via interfaces. Interfaces can be any type of interface capable of receiving information over a network, such as an Ethernet interface, a wireless networking interface, a fiber-optic networking interface, a modem, and so forth. Server also includes a processor and memory and a bus system including, for example, an information bus and a motherboard, can be used to establish and to control information communication between the components of server.

Processor may include one or more microprocessors. Generally, processor may include any appropriate processor and/or logic that is capable of receiving and storing information, and of communicating over a network (not shown). Memory can include a hard drive and a random access memory storage device, such as a dynamic random access memory computer readable hardware storage devices and media and other types of non-transitory storage devices.

Embodiments can be implemented in digital electronic circuitry, or in computer hardware, firmware, software, or in combinations thereof. Computer programs can be implemented in a high-level procedural or object oriented programming language, or in assembly or machine language if desired; and in any case, the language can be a compiled or interpreted language. Suitable processors include, by way of example, both general and special purpose microprocessors. Generally, a processor will receive instructions and information from a read-only memory and/or a random access memory. Generally, a computer will include one or more mass storage devices for storing information files; such devices include magnetic disks, such as internal hard disks and removable disks; magneto-optical disks; and optical disks. Storage devices suitable for tangibly embodying computer program instructions and information include all forms of non-volatile memory, including by way of example semiconductor memory devices, such as EPROM, EEPROM, and flash memory devices; magnetic disks such as internal hard disks and removable disks; magneto-optical disks; and CD_ROM disks. Any of the foregoing can be supplemented by, or incorporated in, ASICs (application-specific integrated circuits).

Other embodiments are within the scope and spirit of the description claims. For example, due to the nature of software, functions described above can be implemented using software, hardware, firmware, hardwiring, or combinations of any of these. Features implementing functions may also be physically located at various positions, including being distributed such that portions of functions are implemented at different physical locations. Other embodiments are within the scope of the following claims.

What is claimed is:

1. An system comprises:

a system processor device;

system memory in association with the system processor device; and a plurality of sensor devices, each of the plurality of sensor devices comprising:

at least one sensor element;

a sensor processor device coupled to the at least one sensor element;

a sensor memory in communication with the sensor processor device; and a storage device that stores a program of computing instructions configured to cause the sensor processor device to:

receive sensor data from the at least one sensor element of a corresponding one of the plurality of sensor devices;

analyze the received sensor data for an occurrence of an alarm condition;

receive sensor data from at least one other of the plurality of sensor devices that is in a peer to peer relationship with the corresponding one of the plurality of sensor devices;

analyze the received sensor data from the at least one other of the plurality of sensor devices to validate whether an alarm condition raised by the at least one other of the plurality of sensor devices is a valid alarm or a false alarm, with the at least one other of the plurality of sensor devices communicating the occurrence of the alarm condition directly by a message transmitted over a local network to the corresponding one of the plurality of sensor devices;

send a composite declaration of the alarm condition to the system processor device when the corresponding one of the plurality of sensor devices and the at least one other of the plurality of sensor devices each detect the occurrence of the alarm condition; and send results of the analyzed sensor data to the at least one other of the plurality of sensor devices that is in the peer to peer relationship with the corresponding one of the plurality of sensor devices.

2. The system of claim 1 wherein the sensor data received from the at least one other of the plurality of sensor devices is a binary signal sent by the corresponding one of the plurality of sensor devices.

3. The system of claim 1 wherein the sensor data received from the at least one other of the plurality of sensor devices is a signal that includes metadata, with the metadata comprising information resulting from processing of inputs by the corresponding one of the plurality of sensor devices and data regarding a state of an environment within range of the at least one other of the plurality of sensor devices.

4. The system of claim 3 wherein the computing instructions further comprise instructions to:

determine whether there was an indication of a forced entry;

determine whether there was an indication of a perimeter presence using the metadata; and determine whether there was an indication of a valid interior violation.

5. The system of claim 1 wherein the computing instructions further comprise instructions to:

maintain counts of and/or record details regarding false alarms asserted by the plurality of sensor devices; and periodically send information regarding these false alarms to a monitoring station.

6. A sensor device comprising:

at least one sensor element;

a processor device;

a memory in communication with the processor device;

a storage device that stores a program of computing instructions configured to cause the processor device to:

receive sensor data from the at least one sensor element of the sensor device;

analyze the received sensor data for the presence of an alarm condition;

receive sensor data from a second, different sensor device that is in a peer to peer relationship with the sensor device;

analyze the received sensor data from the second, different sensor device that is in a peer to peer relationship with the sensor device to validate whether the alarm condition is a valid alarm or a false alarm, with the sensor device receiving a communication of an occurrence of the alarm condition directly from the second, different sensor device by a message transmitted over a local network;

send the occurrence of the alarm condition as a composite event declaration when the sensor device and the second, different sensor device each detect the occurrence of the alarm condition; and send results of the analyzed sensor data to the second, different sensor device that is in the peer to peer relationship with the sensor device;

wherein the sensor device further comprises a network interface configured to communicate the analyzed sensor data and the alarm conditions to other sensor devices that are in a peer to peer relationship with the sensor device.

7. The sensor device of claim 6, further comprising a plurality of sensor elements that includes the at least one sensor element.

8. The sensor device of claim 7 wherein the sensor data received from the at least one sensor element is sensor metadata, with the metadata comprising information resulting from processing of inputs by the sensor device and data regarding a state of an environment within range of the sensor device.

9. The sensor device of claim 6 wherein the computing instructions further comprises instructions to analyze the sensor data received from the at least one sensor element according to order of arrival of the sensor data received from the at least one sensor element.

10. The sensor device of claim 6 wherein the sensor device further comprises:

a plurality of sensor elements including the at least one sensor element, and the computing instructions further comprise instructions to analyze data received from the plurality of sensor elements according to order of arrival of the sensor data received from the plurality of sensor elements.

11. The sensor device of claim 10 wherein the plurality of sensor elements are selected from the group consisting of contact switches and glass break sensors, enhanced motion detectors, video cameras, microphones and/or other sound capturing devices.

12. The sensor device of claim 6 wherein the network interface is configured to send the composite event declaration to a detection panel.

13. The sensor device of claim 8 wherein the processor device is further configured to:

determine whether there was an indication of a forced entry;

determine whether there was an indication of a perimeter presence using the metadata; and determine whether there was an indication of a valid interior violation.

14. The sensor device of claim 7, wherein the computing instructions further comprise instructions to analyze binary outputs from conventional sensor devices and metadata outputs from other sensor devices to determine whether to assert the alarm condition.

15. The sensor device of claim 13 wherein the processor device is further configured to:

process the metadata to assign a first one of a plurality of different levels of awareness; and communicate the assigned first one of the plurality of different levels of awareness to a monitoring station.

* * * * *